United States Patent [19]

Druffel

[11] Patent Number: 4,679,513

[45] Date of Patent: Jul. 14, 1987

[54] THREAD-TENSIONING DEVICE FOR A BOBBIN HOUSING

[75] Inventor: Erich Druffel, Bielefeld, Fed. Rep. of Germany

[73] Assignee: Durkoppwerke GmbH, Fed. Rep. of Germany

[21] Appl. No.: 921,783

[22] Filed: Oct. 21, 1986

[30] Foreign Application Priority Data

Oct. 21, 1985 [DE] Fed. Rep. of Germany .... 3537391.1

[51] Int. Cl.[4] ..... D05B 57/14

[52] U.S. Cl. ..... 112/229; 242/156.1; 112/231

[58] Field of Search ..... 112/229, 230, 231, 228, 112/181, 184; 242/156.1

[56] References Cited

U.S. PATENT DOCUMENTS

| | | | |
|---|---|---|---|
| 2,299,524 | 10/1942 | Chason | 112/231 |
| 2,949,874 | 8/1960 | Kuhar | 112/231 |
| 2,973,920 | 3/1961 | Kucmerosky | 242/156.1 X |
| 3,051,108 | 8/1962 | Ketterer | 112/229 X |
| 3,568,616 | 3/1971 | Coulomba | 112/229 |
| 3,595,497 | 7/1971 | Boatright | 242/156.1 X |
| 4,009,670 | 3/1977 | Mitchell | 112/231 |
| 4,235,178 | 11/1980 | Ackermann | 112/229 |
| 4,331,090 | 5/1982 | Hanyu et al. | 112/229 |

FOREIGN PATENT DOCUMENTS

| | | |
|---|---|---|
| 1070001 | 5/1960 | Fed. Rep. of Germany . |
| 3003501 | 8/1980 | Fed. Rep. of Germany . |
| 3116399 | 5/1982 | Fed. Rep. of Germany . |

*Primary Examiner*—H. Hampton Hunter

*Attorney, Agent, or Firm*—Ostrolenk, Faber, Gerb & Soffen

[57] ABSTRACT

A thread-tensioning device for being mounted on a bobbin housing, the bobbin housing having an upper part and a lower part which define a space for receiving a bobbin, and a jacket for substantially surrounding the bobbin. The thread-tensioning device includes a thread-tensioning member, such as a lever, having a first end swingably supported on the upper part of the housing, and a second end comprising a finger for bearing on the thread package on the bobbin. A central part of the lever is received by a slot in the jacket of the bobbin housing. A leaf spring bears upon the lever to urge the finger toward the interior of the bobbin-receiving space and against the thread package. The arrangement produces a detaining force and a braking force which combine to result in a relatively constant thread-tensioning force.

5 Claims, 6 Drawing Figures

THREAD-TENSIONING DEVICE FOR A BOBBIN HOUSING

BACKGROUND OF THE INVENTION

1. Field of the Invention

The invention relates to a thread-tensioning device for being attached to a bobbin housing, the bobbin housing having a cylindrical jacket for surrounding a bottom-thread bobbin received therein.

2. Description of Related Art

Thread-tensioning devices mounted on bobbin-receiving housings are known. In one such device, a leaf spring is so fastened to the bobbin housing that its resilient end rests against a part of the bobbin housing whereby a clamping action is produced. The pressing force of the leaf spring is adjustable by a regulating screw therein. The bottom thread drawn off from a bottom-thread bobbin contained within the bobbin housing is conducted through the clamping location so that during the process of drawing off the thread a resultant thread-tensioning force made up of these components' braking force and detaining force is imposed upon it.

These known thread-tensioning devices have the disadvantage - since no sensing of the diameter of the package of thread is provided - that is present in all lock-stitch loopers known up to the present time, namely that the thread-tensioning force exerted upon the bottom thread when it is drawn off is less when the thread package is at its maximum diameter than when it is at its minimum diameter.

SUMMARY OF THE INVENTION

Accordingly, a principal object of the invention is to provide a thread-tensioning device on a bobbin housing, particularly of a lock-stitch looper, which exerts on the thread, when the thread is being drawn off, a braking force which is directly related or directly proportional to the remaining diameter of the package of thread.

With the thread-tensioning device of the invention, it is now possible, while drawing off the bottom thread from the bottom-thread bobbin, to obtain a resultant thread-tensioning force which, in the ideal case, remains constant at both the maximum and the minimum diameter of the package of thread. This is the result of the braking force, which is directly proportional or directly related to the diameter of the thread package, being superimposed on the detaining force, which is inversely proportional or inversely related to the diameter of the thread-package, the latter force being produced by the friction of the bottom-thread bobbin, which moves intermittently in the bobbin housing, and by the changing angles of deflection of the bottom thread. The resultant thread-tensioning force thus results from the combination of the detaining force and the braking force. Furthermore, undesired continued rotation of the bottom-thread bobbin, whch can occur during the cutting of the thread, is avoided by the thread-tensioning device.

According to an important feature of the invention, a thread-tensioning device may be mounted on a bobbin housing having an upper part and a lower part, which define a space for receiving a bobbin. Advantageously, the bobbin housing has jacket means for substantially surrounding the bobbin received therein, and the thread-tensioning device comprises a thread-tensioning member having a first end supported on the housing, and a second end comprising finger means for bearing upon a thread package accommodated on the bobbin.

The thread-tensioning member may comprise a lever having first and second ends, which is swingably mounted at its first end on the upper housing part, a central part of the lever being received by a slot in the jacket means of the bobbin housing. Spring means may be provided for bearing upon the lever and thereby urging the finger means toward the interior of the bobbin-receiving space and against the thread package.

According to another feature, the thread-tensioning member may comprise a spring bar mounted at one end on the housing, the other end comprising a feeler finger extending toward the interior of the bobbin-receiving space.

BRIEF DESCRIPTION OF THE DRAWINGS

Illustrative embodiments of the invention will now be explained with reference to FIGS. 1 to 6 of the drawings, in which.

DETAILED DESCRIPTION OF THE EMBODIMENT

Figure 2:
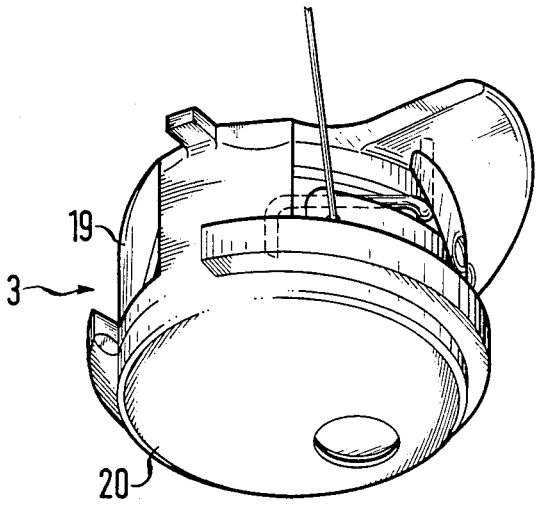
FIG. 2 is a perspective view of an entire bobbin housing including an upper part and a lower part.

FIG. 2 shows a bobbin housing 3 comprising an upper part 19 and a lower part 20, a bottom-thread bobbin 14 being contained therein. The upper part 19 and the lower part 20 are connected in form-locked but easily detachable manner to each other by means of a swingable holding nose, so that an empty bottom-thread bobbin 14 in the bobbin housing 3 can be easily replaced by a full one.

The bobbin housing 3 may be part of a known typ of lock-stitch looper which has a vertically arranged looper shaft, not further described or shown here. The thread-tensioning device of the invention can, however, also be attached to a correspondingly formed upper part of a bobbin housing of a lock-stitch looper with a horizontal looper shaft. The bottom thread 13, which is wound on a hub 21 of the bottom-thread bobbin 14, forms a thread package 9 whose outside diameter is dependent on the degree to which the bottom-thread bobbin 14 is filled.

Figure 1:
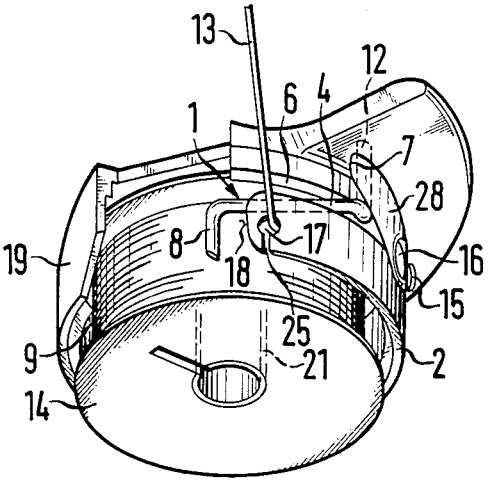
FIG. 1 is a perspective view of the upper part of a bobbin housing, having therein a bottom-thread bobbin.

In accordance with FIG. 1, the upper part 19 has a cylindrical jacket 2 which surrounds the greater part of the space intended to receive the bottom-thread bobbin 14. A leaf spring 28 is attached to the jacket 2 on its outer cylindrical surface by a screw 15. The leaf spring 28 is so bent that its resilient end 7 extends toward, and normally rests against, the jacket 2. The pressing force which results therefrom can be varied by adjustment of a regulating screw 16.

Figure 3:
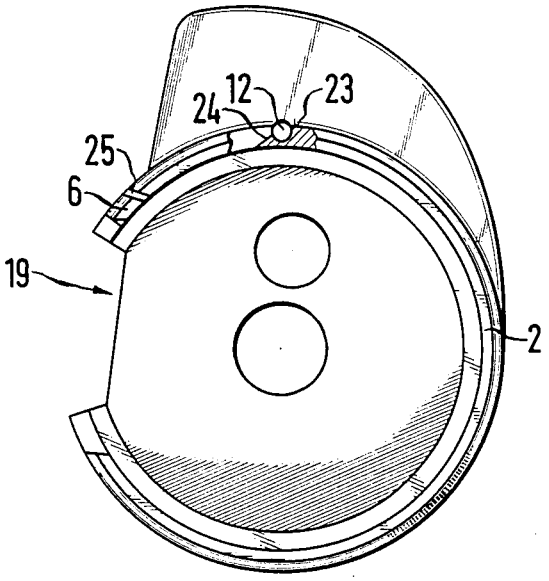
FIG. 3 is a bottom view of the upper part of the bobbin housing, the attachment parts being omitted.
Figure 4:
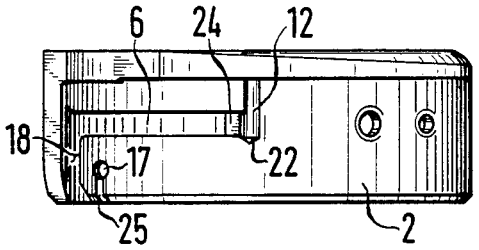
FIG. 4 is a side view of the upper part of the bobbin housing, the attachment parts being omitted.
Figure 5:
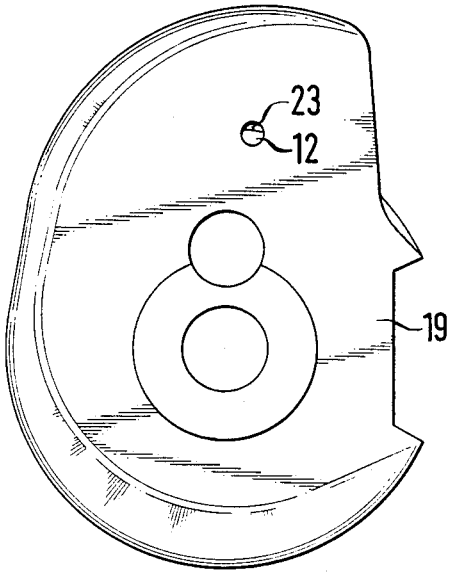
FIG. 5 is a top viw of the upper part of the bobbin housing.

In accordance with FIGS. 3 and 5, a hole 12 whose tip extends deeply into the body of the jacket 2 - as can be noted from FIG. 4 - is provided in the upper part 19. The hole 12 is so positioned in the upper part 19 that its middle line, as shown in FIG. 3, is located slightly inward from an edge 23 of the jacket 2. In this way, the hole 12 provides an outwardly open groove of circular cross-section in the body of the jacket 2. As shown in FIGS. 1 and 4, a slot 6 is provided in the jacket 2, said slot extending from a front edge 18 of the jacket 2, to the rear edge of the groove formed by the hole 12. The slot 6 is so formed on a portion of that an oblique extension 24 is formed on a portion of the jacket 2 at the end of said groove.

In the vicinity of the front edge 18, a thread-guide hole 17 is provided in the jacket 2, into which opens a treading slot 25. The bottom thread 13 which has been withdrawn from the bottom-thread bobbin 14 is conducted through the thread-guide hole 17, as shown in FIG. 1.

Figure 6:
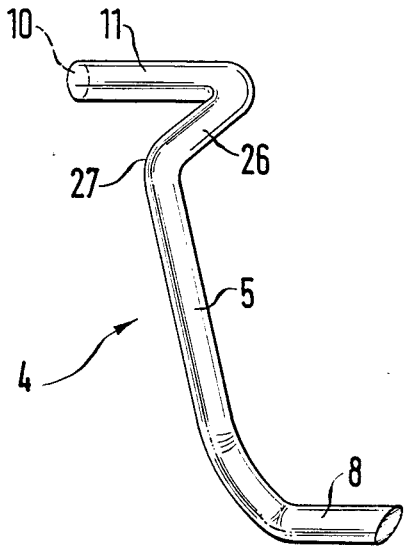
FIG. 6 is a perspective view of a swingable lever which senses the diameter of the thread package.

A lever 4 which is made of spring steel and acts as a thread-tensioning member 1 has a circular cross-section at all places, as shown in FIG. 6. This lever 4 may also have other forms, for example a rectangular cross-section. The lever 4 comprises a middle part 5 and further portions branching off from the top and bottom thereof. At the top there extends from the middle part 5 a first arm 26 arranged at right angles to the middle part 5. Branching off from the arm 26 is a second arm 11, also extending at a right angle. In its lower region, the middle part 5, as shown in FIG. 6, is first of all slightly bent, this bent portion being extended by a feeler finger 8 which extends at a right angle to the middle part 5. The feeler finger 8 and the arm 11 are aligned parallel to each other.

The arm 11 is introduced into the hole 12, and thereby is swingably mounted in the upper part 19, the middle part 5 being guided by the slot 6. As shown in FIGS. 1 and 2, the bottom of the leaf spring 28 presses against a bend 27 between the arm 26 and the middle part 5 of the lever 4. Thus, the further the feeler finger 8 moves away from the center of the upper part 19, the more the leaf spring 28 is pressed outward by the bend 27.

In order to permit the dependable insertion of a bottom-thread bobbin 4 filled with the bottom thread 13 into the upper part 19, movement of the lever 4 toward the center of the upper part 19 is limited by the extension 24, which acts as a stop. Upon the introduction of the bottom-thread bobbin 14, the feeler finger 8 is arranged to rest dependably against the thread package 9. If the latter is of maximum diameter, then the leaf spring 28 experiences its maximum deflection via the widely swung out feeler finger 8 and the lever 4, the bend 27 assuming its highest position with respect to the jacket 2. In this case, the leaf spring 28 presses with maximum force against the lever 4. This force, which is directly proportional to the diameter of the thread package, is exerted via the feeler finger 8 directly on the thread package 9, so that a braking force which is dependent on the diameter is produced upon the drawing off of the bottom thread 13. This braking force is superimposed upon the above-mentioned detaining force, which is inversely related to the thread package diameter. thus, a relatively constant thread-tensioning force may be obtained.

According to an alternate embodiment, the thread-tensioning member may be a spring bar mounted at one end on the housing, the other end comprising a feeler finger extending toward the interior of the bobbin-receiving space.

Although an illustrative embodiment of the invention has been described herein, the same is for purposes of illustration and not limitation. Modifications and variations thereon may occur to one skilled in the art within the scope of the invention, as defined only by the claims.

What is claimed is:

1. A thread-tensioning device for a bobbin housing, the bobbin housing having an upper part and a lower part defining a space for a bobbin, and having jacket means for substantially surrounding a bobbin received therein, the thread-tensioning device comprising:

a thread-tensioning member having a first end supported on the housing, a second end of the thread-tensioning member comprising finger means for bearing upon a thread package accommodated on the bobbin.

2. A device as in claim 1, said thread-tensioning device further comprising means for urging the finger means toward the interior of the bobbin-receiving space and toward the thread package.

3. A device as in claim 2, wherein said thread-tensioning member comprises a lever having first and second ends, the lever being swingably mounted at its first end on the upper housing part, and a central part of the lever intermediate the first and second ends being received by a slot in the jacket means of the bobbin housing.

4. A device as in claim 3, wherein the lever has a substantially constant circular cross-section.

5. A device as in claim 3, wherein the lever has at its first end a first arm extending from the central part by a substantially right-angle bend, and a second arm extending at substantially right angles form the first arm, the second arm being received by retaining means on the upper housing part for being swingably mounted thereon, and the finger means extends at substantially right angles from the central part at the second end of the lever, the finger means comprising a finger which is substantially parallel with the second arm.

* * * * *